United States Patent [19]

Jumel et al.

[11] Patent Number: 4,620,466

[45] Date of Patent: Nov. 4, 1986

[54] CUTTING MACHINE

[75] Inventors: Jean P. Jumel, Le Vesinet; Bernard Guala, Courbevoie, both of France

[73] Assignee: Societe Nationale Industrielle et Aerospatiale, Courbevoie, France

[21] Appl. No.: 661,784

[22] Filed: Oct. 16, 1984

[30] Foreign Application Priority Data

Oct. 17, 1983 [FR] France ..... 83 16466

[51] Int. Cl.[4] ..... D06H 7/00; B26F 1/26; B26F 3/00

[52] U.S. Cl. ..... 83/177; 83/53; 83/701; 83/925 CC

[58] Field of Search ..... 83/177, 53, 925 CC

[56] References Cited

U.S. PATENT DOCUMENTS

| | | | |
|---|---|---|---|
| 3,541,907 | 11/1970 | Wiatt . | |
| 3,730,040 | 5/1973 | Chadwick et al. | 83/177 |
| 3,877,334 | 4/1975 | Gerber . | |
| 3,978,748 | 9/1976 | Leslie et al. | 83/177 X |
| 4,116,097 | 9/1978 | Graham . | |
| 4,137,804 | 2/1979 | Gerber et al. | 83/177 |
| 4,140,038 | 2/1979 | Higgins | 83/177 |
| 4,501,182 | 2/1985 | Jardat et al. | 83/177 |

FOREIGN PATENT DOCUMENTS 1479158 3/1967 France .

*Primary Examiner*—Donald R. Schran

[57] ABSTRACT

Machine for cutting strip-like material by a high pressure fluid jet comprising a substantially flat bearing surface able to support the strip-like material a cutting nozzle discharging a fluid jet under high pressure towards the strip-like material, means for displacing the nozzle in a direction Y perpendicular to the strip length, wherein it also comprises means for displacing the strip-like material in both senses according to a direction X parallel to the length of the strip, in such a way that the combined displacements of the strip-like material and the nozzle make it possible to make cuts of a random shape over a random length of the said strip-like material, wherein the bearing surface of the machine upstream of the cutting nozzle and on either side of the means for displacing the strip-like material, is in the form of a fixed table on which the latter moves within a guidance tunnel.

10 Claims, 4 Drawing Figures

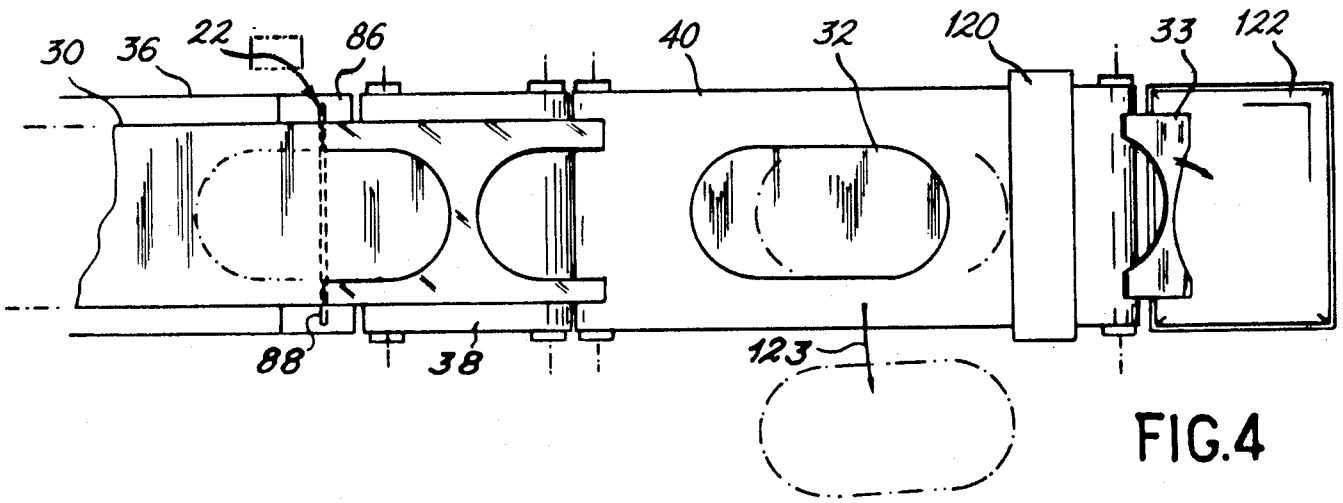
FIG.4
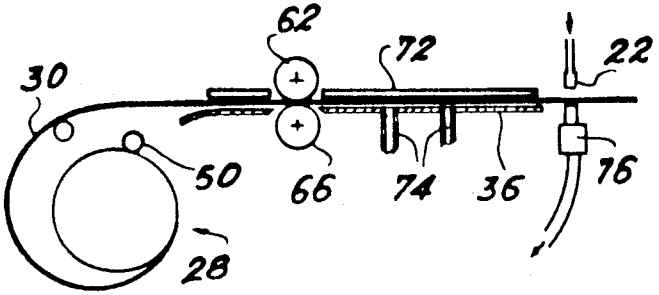
FIG.

CUTTING MACHINE

BACKGROUND OF THE INVENTION

The present invention relates to a machine for cutting along a random line a strip-like material by means of a high pressure fluid jet.

Machines are known which make it possible to cut a product or part, whose dimensions do not exceed those of the table supporting the same. In such machines, the cut can be obtained either by the combination of a transverse displacement of the cutting tool and a longitudinal displacement of the table supporting the part, or by a transverse and longitudinal displacement of the cutting tool, the table then remaining fixed. A machine of this second type is described in French Pat. No. 1,479,158.

With both machine types, it is possible to cut a part along a random line. However, the table must either be very long, or as long as the product to be cut, which leads to large overall dimensions during the cutting of very long parts, as well as to significant idle times during the mass production of certain parts, because it is necessary to change the product between each cutting operation.

SUMMARY OF THE INVENTION

The present invention relates to a cutting machine not suffering from the disadvantages of the prior art machines and more particularly permitting, with reduced overall dimensions, the cutting of a product in the shape of a strip, which permits the cutting of parts having a random length and the mass production of parts at elevated speed, as a result of the advance of the strip.

Therefore, the present invention relates to a machine for cutting strip-like material by a high pressure fluid jet comprising a substantially flat bearing surface able to support the strip-like material, a cutting nozzle discharging a fluid jet under high pressure towards the strip-like material, means for displacing the nozzle in a direction Y perpendicular to the strip length, wherein it also comprises means for displacing the strip-like material in both directions according to a direction X parallel to the length of the strip, in such a way that the combined displacements of the strip-like material and the nozzle make it possible to make cuts of a random shape over a random length of the said strip-like material.

It is clear that the combination of the movements of the nozzle and the actual strip make it possible to obtain any form of cut contained in the width of the strip and without any length limitation. Moreover, there are virtually no idle times between the cutting of successive parts.

In view of the fact that the material to be cut is generally wound or reeled and can have a certain rigidity, it can have a tendency to maintain a slight curvature when moving on the machine. This is not desirable because the strip-like material may then get caught on certain parts of the machine and also because the accuracy of the cut may be reduced.

Thus, according to another aspect of the invention, the bearing surface of the machine upstream of the cutting nozzle and on either side of the means for displacing the strip-like material, is in the form of a fixed table on which the latter moves within a guidance tunnel.

In view of the fact that the material to be cut can in particular be a preimpregnated composite material, whose protective sheet or separator covering the lower face is generally removed to facilitate the subsequent use of the cut and in order to reduce the time for producing the same, said lower face can be adhesive. When the strip-like material moves within the tunnel, it is consequently desirable to prevent the said lower face from adhering to the fixed table. Therefore, means can be provided for producing a fluid cushion between the table and the strip-like material.

Preferably, in order to permit a visual inspection of the cut, bearing in mind the fact that the strip-like material can be displaced in both senses, the tunnel is transparent.

Conventionally, the cutting machine according to the invention comprises a system for the recovery of the jet which faces the cutting nozzle and on the side opposite to the material to be cut. According to another aspect of the invention, this system comprises, in the trajectory of the jet, at least one first metal plate ensuring the breaking up of the jet and a device for detecting wear to said plate having a normally tight cavity located below the plate and whose lower wall has at least one further metal plate against which the jet strikes when the first plate is perforated as well as means for detecting the arrival of the jet in said cavity.

Preferably, the latter means comprise an electric circuit having an indicator, whose operation is controlled by the closing of the said circuit resulting from contacting between said other plate and an electrode located in the cavity, when the fluid jet enters the latter.

In order to both confine the noise which occurs in the recovery means within the latter and to prevent vapours formed during the breaking up of the jet escaping upwards, the bearing surface preferably has a fixed false table between the nozzle and the jet recovery system having a slot which is essentially of the same width as the jet discharged by the nozzle, said slot preferably being cut directly in the table by the jet. The jet recovery system moving at the same time as the nozzle then comprises at its upper end in contact with the table, a seal having a reduced friction coefficient with the latter.

It is consequently possible to eliminate the vapour suction system generally provided in this type of generator, the broken up fluid being discharged by gravity.

According to yet another feature of the invention, the machine comprises means for the automatic control of the means for displacing the nozzle and means for displacing the strip-like material, in order to ensure the cutting of pieces and scraps in the latter, the bearing surface having downstream of the cutting nozzle at least one conveyor belt, whose forward movement carries the scraps up to means for removing scraps of the cut material, as well as means for detecting the presence of a piece on the conveyor belt controlling the stoppage thereof, said detection means being respectively activated and deactivated by the automatic control means, as a function of whether they are ensuring the cutting of a piece of a scrap, in order to control the stopping of the conveyor belt to permit the gripping of pieces and for carrying the scraps, without stopping the conveyor belt, up to the scrap removal means.

In this case, a second conveyor belt, whose forward movement is automatically controlled during a given time by the automatic control means following the cutting of a piece or a scrap, can be positioned between the cutting nozzle and the conveyor belt, in order to facilitate the cutting of the strip-like material.

BRIEF DESCRIPTION OF THE DRAWINGS

The invention is described in greater detail hereinafter relative to non-limitative embodiments and the attached drawings, wherein show:

FIG. 2 a cross-sectional view in diagrammatic form of that part of the machine upstream of the cutting nozzle.

FIG. 4 a plan view diagrammatically illustrating the operation of the machine, as a function of whether the element cut by it is a scrap or a piece.

DETAILED DESCRIPTION OF THE INVENTION

Figure 1:
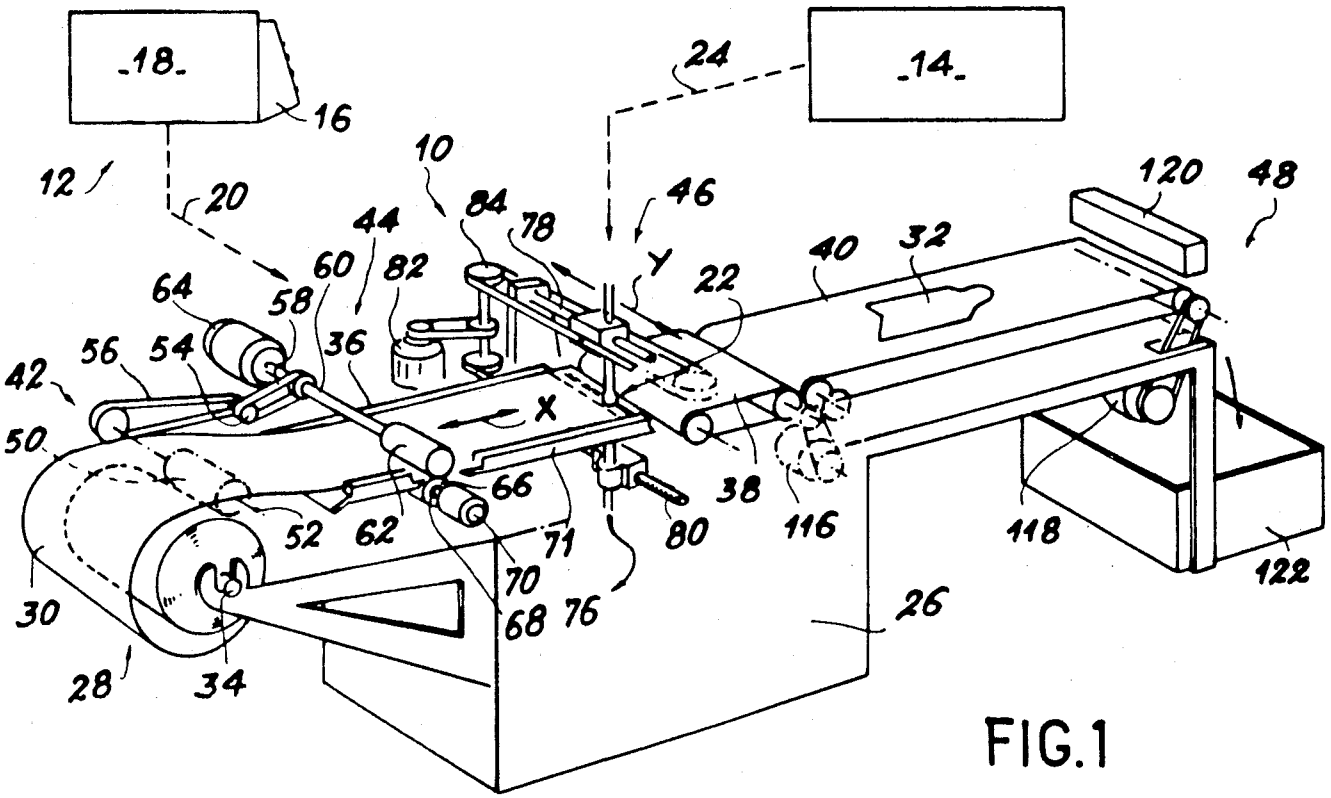
FIG. 1 a perspective view diagrammatically showing a cutting machine according to the invention.

On firstly referring to FIG. 1, it can be seen that the cutting machine according to the invention comprises three separate parts constituted by an electromechanical assembly 10, a control assembly 12 and a very high pressure fluid source 14. These three assemblies can be physically separated from one another as shown in the drawing.

The control assembly 12 comprises a digital control 16 and a control bay 18. It is connected to the electromechanical assembly 10 by connecting cables 20.

The very high pressure fluid source 14 is constituted by a high pressure group usually supplying water under very high pressure and which is carried up to the cutting nozzle 22 of assembly 10 by a pipe 24.

The electromechanical assembly 10 comprises a frame 26 which, at one of its ends, carries a reel 28 of a strip-like material 30, which is to be cut into pieces 32 having a random shape. Reel 28 is mounted on a spindle 34, which can freely rotate on frame 26, so as to permit the free unwinding of strip 30.

The upper horizontal face of frame 26 constitutes a bearing surface formed, from the end of the frame carrying the reel and up to the opposite end, a fixed table 36, a first endless conveyor 38 of limited length and a second endless conveyor 40 of greater length. The width of these different elements constituting the bearing surface on which is received the strip 30 slightly exceeds the width of the latter, so as to permit a guidance of the strip on table 36.

Moreover, table 26 supports, from the end carrying reel 28 up to its opposite end, a device 42 for unwinding strip 30, a device 44 for the advance and guidance of the strip on table 36, a cutting device 46 located between table 36 and the first conveyor 38 and a device 48 for sorting and removing scraps permitting a gripping of pieces.

The unwinding device 42 has a rubber-lined roller 50, which drives the reel 28 by friction. To this end, roller 50 is fixed to a spindle 52 parallel to the reel spindle 34 and said spindle 53 is mounted in rotary manner on the end of a not shown, articulated arm, whose opposite end is articulated about a fixed spindle 54. The rubber-lined roller 50 is consequently pressed against the reel under the action of gravity, which may be reinforced by the action of not shown elastic means.

Two belts 56 and 58 mounted on appropriate pulleys are used for transmitting to the shaft 52 carrying roller 50, the rotary movement of a spindle 60 of the strip advance device 44, whilst passing via the fixed spindle 54.

Device 44 for the forward movement and guidance of strip 30 comprises a drive roller 62 mounted on the spindle 60 of the motor 64 above strip 30. A metal roller 66 is positioned below strip 30 in a slot in table 36, in such a way that its upper generatrix is flush with the upper face of the latter, as illustrated by FIG. 2. Spindles 60 and 68 of roller 62 and roller 66 are parallel to spindle 34 of reel 28 and located in the same vertical plane, so as to press strip 30 between them. This result is obtained by applying roller 62 to metal roller 66 with a given pressure and with the aid of not shown, known means. A coder or counter 70 is associated with the metal roller 66, in order to determine the number of revolutions thereof and consequently the length of the strip passing over table 36.

According to an essential feature of the present invention, the motor 64 used for controlling the forward movement of strip 30 on table 36 can move the said strip parallel to its length in both directions via the mechanism described hereinbefore and as illustrated by arrow X in FIG. 1.

It has been seen that belts 56 and 58 enable motor 64 to simultaneously rotate rollers 50 and 62. The diameters of these rollers, as well as the diameters of the pulleys, on which the belts are received, are chosen in such a way that the peripheral speeds of these two rollers are equal to one another. Thus, the strip advance device 44 does not have to overcome the inertia of reel 28, but solely that of the strip portion located between roller 50 and cutting device 46 and that of the rigid roller 66.

As illustrated by FIG. 1, a precise positioning of the strip in direction X is obtained by maintaining the latter against a smooth guide 71, located along one of the longitudinal edges of table 36.

In order to take account of the fact that the strip-like material 30 to be cut can have a certain rigidity, according to a preferred embodiment of the invention, it is ensured that the strip is maintained on table 36, so as to make sure that the strip does not retain a certain curvature, which could both significantly reduce the accuracy of cut and lead to incidents, such as the strip getting caught on certain projecting parts of the machine.

As is diagrammatically illustrated in FIG. 2, the good flatness of the unwound strip is obtained in the cutting area by placing on the table 36 a tunnel 72 having a slot for the passage of roller 62.

When the strip-like material to be cut is a preimpregnated composite material, the latter is generally stored in the form of a continuous strip in the adhesive state between two sheets called separators. When the composite material strip is unwound for cutting purposes, the separator covering the lower face thereof, i.e. that turned towards the machine plate is removed, so that on the one hand the subsequent use of the cut is facilitated and on the other to reduce the handling times of the cuts. Thus, if the two separators remained in place, the operator would have to turn over the cut to remove the second separator and, in his haste, might leave behind fragments, which would be prejudicial to the quality of the composite material.

Thus, according to a preferred embodiment of the invention, the machine also has orifices 74 in table 36 in accordance with a substantially median plane, as illustrated in FIG. 2. These orifices are supplied with compressed air, which makes it possible to permanently produce an air cushion between the table and strip 30 ensuring that the strip does not adhere to the table. Thus, the precision of the displacement of strip 30 in the direction of axis X is not prejudiced. It should be noted that the air cushion produced between the strip and table 36 tends to move the strip away from the table, but said movement is limited by tunnel 72.

Preferably, tunnel 72 is transparent, so as to permit the visual checking of the cutting operations.

In per se known manner, cutting device 46 has a cutting nozzle 22 arranged vertically above strip 30 and a jet recovery system 76 arranged below the strip and facing nozzle 22. Nozzle 22 and recovery system 76 are mounted on transverse guide columns 78, 80 parallel to the spindle 34 of reel 28. By means of appropriate belts and pulleys designated in a general manner by reference numeral 84, a motor 82 makes it possible to displace nozzle 22 and recovery means 76 along their respective guide column in both senses, in such a way that they are permanently facing one another. The thus obtained transverse displacement is designated by arrow Y in FIG. 1.

According to an essential feature of the invention, it can be seen that it is possible, by simultaneously controlling the operation of motors 64 and 82 with the aid of digital controls 16 and using an appropriate programme, to cut from strip 30 pieces 32 having random shapes and dimensions, within the width and length limits of the strip, by means of an electromechanical assembly 10, whereof the dimensions can remain relatively small. The machine according to the invention also makes it possible to cut in series a large number of pieces, in accordance with a given programme and without loss of time.

Figure 3:
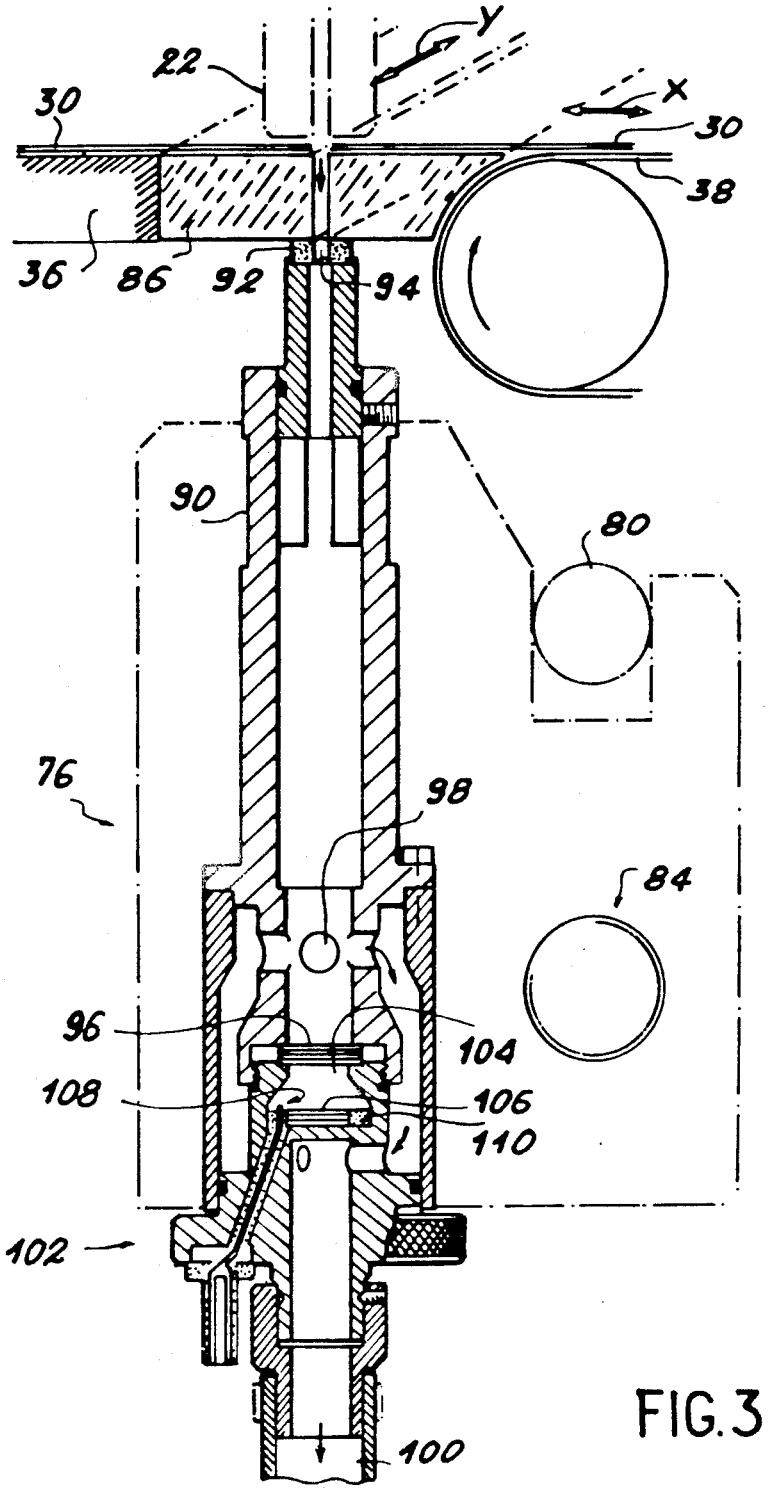
FIG. 3 a larger scale perspective view in partial section more particularly showing the recovery system facing the cutting nozzle.

On referring to FIG. 3, it can be seen that the system 76 for recovering the jet supplied by nozzle 22 is placed below a false table 86 extending table 36 and having a slot 88, whose width is substantially equal to the width of the jet leaving nozzle 22. In order that the width of slot 88 is as small as possible and that said slot is placed exactly in the alignment of the jet, the false table 86 is preferably made from a material which can be cut by the jet, such as a plastics material and slot 88 is cut from said material by the jet.

In its upper part, the recovery system 76 has a vertically axis tube 90 having at its upper end a cylindrical seal 92 made e.g. from felt, so as to have a minimum friction coefficient with the false table 86. Seal 92 is centrally perforated by a hole 94, whose diameter is substantially equal to the jet diameter. Thus, in combination with the false table 86, this seal makes it possible to confine the noise within the recovery system to the greatest possible extent and prevents water vapour formed therein from escaping through its upper end.

In a conventional manner, after travelling a certain distance within tube 90, the jet is broken up on a horizontal fritted metal plate 96 fixed in the bottom of the tube. Holes 98 formed in tube 90 above plate 96 enable the water vapour formed by the breaking up of the jet to flow by gravity towards a pipe 100. The presence of the false table 96 and the seal 92 make it possible to prevent any risk of water vapour escaping through the top of the tube, so that there is no need, as in the prior art devices, to provide ancillary means for sucking off the water vapour formed as a result of the breaking up of the jet on the plate. Thus, the noise and cost of the machine are reduced.

According to a preferred embodiment of the invention, the recovery system 76 also has means 102 for detecting the perforation of plate 96 by the jet. These means comprise a chamber 104 formed in the lower part of tube 90, below plate 96 and which is normally tight. The lower partition of chamber 104 has, in its central part, a second fritted metal plate 106, as well as an electrode 108 separated from plate 106 by an electrically insulating material block 110. Plate 106 and electrode 108 are connected in a not shown electrical circuit, which also has a wear indicator for plate 96, as well as a power supply.

When plate 96 is perforated by the fluid jet discharged by the cutting nozzle 22, the water passes through chamber 104 and strikes against the plate 106, which ensures the breaking up thereof. The water admitted in this way into chamber 104 brings plate 106 and electrode 108 into contact, which has the effect of closing the electrical circuit and energizing the indicator. It should be noted that the detection of the perforation of plate 96 is substantially immediate and takes place without a single drop of water being discharged to the exterior of recovery system 76.

As stated hereinbefore, the false table 86 is extended by a first conveyor belt 38, whose operation is controlled by a motor 116. A second conveyor belt 50 extends belt 38 and is controlled independently of the latter by a second motor 118. The device for sorting and removing scraps 48 has a means for detecting pieces 32, constituted by a photoelectric barrier 120, placed at the end of conveyor belt 40 and at the end of assembly 10. It also has a reception tank 122 below the end of conveyor 40, so as to receive the scraps carried by the latter.

According to a preferred embodiment of the invention, the different motors 82, 64, 116 and 118 as well as the photoelectric barrier 120 of electromechanical system 10 are controlled by the control assembly 12, in such a way that the cutting of pieces 32 takes place in accordance with a given programme, the scraps resulting from the cutting operation drop automatically into tank 122 and conveyor 40 stops when it supports a piece 32.

In order that device 48 can sort between pieces and scraps, the digital control 16 is designed in such a way that it supplies an activation instruction for the photoelectric barrier 120 when it controls the cutting of a piece in strip 30 with the aid of motors 64 and 82 and transmits a deactivation instruction for photoelectric barrier 120 when it controls the cutting of a scrap in the strip-like material. Bearing in mind the latter remark, the machine operates as follows. The control system 12 continuously transmits and in accordance with a predetermined programme, instructions for cutting pieces and scraps from strip 30. These instructions lead to the combined displacements of the cutting nozzle 22 and the strip to be cut, respectively in directions Y and X, leading to the successive cutting of pieces and scraps in accordance with this programme.

Whenever the cutting of an element is finished, no matter whether this element is a piece or a scrap, the control system 12 starts up the motor 116, which was previously stopped during cutting. The piece or scrap is thus conveyed by conveyor 38 up to conveyor 40, after which conveyor 38, whose motor 116 is applied in a timed manner, stops. Motor 118 of conveyor 40 is normally continuously supplied from control system 12, so that the piece or scrap whose cutting has just been completed is conveyed up to the end of conveyor belt 40. At this stage and as is diagrammatically illustrated by FIG. 3, a distinction must be made between two different cases.

In the first case, the element located on the conveyor 40 is a scrap 33. It has been seen hereinbefore that in this case the photoelectric barrier 120 is deactivated. Thus, the barrier does not detect the passage of the scrap, so that motor 118 remains energized and the scrap drops into tank 122 at the end of conveyor 40.

In the opposite case, where the element which has been cut is a piece 32, photoelectric barrier 120 is activated, so that it immediately detects the piece when it reaches its level. This has the immediate effect of stopping motor 118 and consequently conveyor 40. The piece can then be gripped by any means, i.e. either manually, or by a suitable automatic handling device. This gripping is diagrammatically illustrated by arrow 123 in FIG. 4.

As soon as the piece is removed from conveyor 40, the signal emitted by the photoelectric barrier 120 disappears and motor 118 again controls the forward movement of conveyor 40 up to the arrival of a new piece, which will in turn be detected by the photoelectric barrier.

The invention has been described hereinbefore relative to non-limitative embodiments and obviously numerous variants are possible thereto without passing beyond the scope of the invention.

What is claimed is:

1. A machine for cutting strip-like material by means of a high pressure fluid jet, comprising a substantially flat bearing surface for supporting the strip-like material, a cutting nozzle for directing a fluid jet under high pressure against the strip-like material, means for displacing said nozzle in a direction Y perpendicular to the strip length, means for displacing the strip-like material in both directions X parallel to the length of the strip, in such a way that the combined displacements of the strip-like material and said nozzle make it possible to make cuts of a random shape over a random length of the said strip-like material, said means for displacing the strip-like material according to the X-directions including a drive roller driven by motor means, and an opposing roller, said drive roller and said opposing roller having parallel spindles located in a common vertical plane so as to press the strip-like material between them, the bearing surface of the machine upstream of the cutting nozzle and on either side of said vertical plane being a fixed table on which is disposed a guidance tunnel for said strip-like material, said tunnel having a slot in which is located said drive roller, and means for producing a fluid cushion between the top of said table and the strip-like material.

2. A machine according to claim 1, wherein the tunnel is transparent.

3. A machine according to claim 1, wherein it also comprises a jet recovery system positioned facing the nozzle and on the other side of the material to be cut, this system comprises, in the trajectory of the jet, at least one first metal plate ensuring the breaking up of the jet and a device for detecting wear to said plate having a normally tight cavity located below the plate and whose lower wall has at least one further metal plate against which the jet strikes when the first plate is perforated as well as means for detecting the arrival of the jet in said cavity.

4. A machine according to claim 3, wherein the means for detecting the arrival of the jet in the cavity comprise an electric circuit having an indicator, whose operation is controlled by the closing of the circuit resulting from the contacting of the other plate and an electrode located in the cavity, when the fluid enters the latter.

5. A machine according to claim 3, wherein the means for displacing the nozzle in direction Y simultaneously act on the jet recovery system, so that the latter is permanently maintained facing the nozzle, said bearing comprising, between the nozzle and the jet recovery system, a fixed false table having a slot substantially of the same width as the jet discharged by the nozzle, the jet recovery system having at its upper end in contact with the table, a seal having a reduced friction coefficient with the latter.

6. A machine according to claim 5, wherein the fixed false table located between the nozzle and the jet recovery system is made from a material which can be traversed by the jet, in such a way that the said slot is directly cut in the table by the same.

7. A machine according to claim 5, wherein the jet recovery system comprises means for removing by gravity fluid broken up by the first plate.

8. A machine according to claim 1, wherein it also comprises means for the automatic control of the means for displacing the nozzle and means for displacing the strip-like material, in order to ensure the cutting of pieces and scraps in the latter, the bearing surface having downstream of the cutting nozzle at least one conveyor belt, whose forward movement carries the scraps up to means for removing scraps of the cut material, as well as means for detecting the presence of a piece on the conveyor belt controlling the stoppage thereof, said detection means being respectively activated and deactivated by the automatic control means, as a function of whether they are ensuring the cutting of a piece of a scrap, in order to control the stopping of the conveyor belt to permit the gripping of pieces and for carrying the scraps, without stopping the conveyor belt, up to the scrap removal means.

9. A machine according to claim 8, wherein the bearing surface comprises, between the cutting nozzle and the conveyor belt, a second conveyor belt, whose forward movement is automatically controlled by the automatic control means following the cutting of a piece or a scrap during a given time.

10. A machine for cutting strip-like material by means of a high pressure fluid jet, comprising a substantially flat bearing surface for supporting the strip-like material, a cutting nozzle for directing a fluid jet under high pressure against the strip-like material, means for displacing said nozzle in a direction Y perpendicular to the strip length, means for displacing the strip-like material in both directions X parallel to the length of the strip, in such a way that the combined displacements of the strip-like material and said nozzle make it possible to make cuts of a random shape over a random length of the said strip-like material, the bearing surface of the machine upstream of said cutting nozzle and on either side of said means for displacing the strip-like material being in the form of a fixed table provided with a guidance tunnel through which the strip moves, and a jet recovery system disposed beneath the material to be cut, facing said nozzle and in alignment with the jet stream produced thereby, said recovery system comprising a hollow body for receiving a jet stream from said nozzle, a first metal plate disposed within said body for breaking up the jet stream, a normally fluid tight cavity located below said first plate, the lower wall of said cavity having a further metal plate against which the jet strikes when said first plate is perforated, and means for detecting perforation of said first plate and consequent arrival of the jet stream in said cavity.

* * * * *